US007325584B2

(12) United States Patent
Bousson

(10) Patent No.: US 7,325,584 B2
(45) Date of Patent: Feb. 5, 2008

(54) MECHANISM FOR TENSIONING A COMPENSATION SPRING FOR A CLOSING OR SUN PROTECTION INSTALLATION

(75) Inventor: Benjamin Bousson, Lombard (FR)

(73) Assignee: SIMU, Gray (FR)

( * ) Notice: Subject to any disclaimer, the term of this patent is extended or adjusted under 35 U.S.C. 154(b) by 323 days.

(21) Appl. No.: 10/508,487

(22) PCT Filed: Mar. 27, 2003

(86) PCT No.: PCT/FR03/00973

§ 371 (c)(1),
(2), (4) Date: Sep. 21, 2004

(87) PCT Pub. No.: WO03/083243

PCT Pub. Date: Oct. 9, 2003

(65) Prior Publication Data

US 2005/0150615 A1 Jul. 14, 2005

(30) Foreign Application Priority Data

Mar. 28, 2002 (FR) ..... 02 03944

(51) Int. Cl.
*E06B 9/56* (2006.01)

(52) U.S. Cl. ..... 160/315; 160/318; 160/191; 192/223.4

(58) Field of Classification Search ..... 160/310, 160/311, 191, 192, 313, 315, 318, 317, 188, 160/309, 321, 322; 192/223.4; 74/531
See application file for complete search history.

(56) References Cited

U.S. PATENT DOCUMENTS

| | | | | |
|---|---|---|---|---|
| 225,857 | A * | 3/1880 | Noyes | 160/315 |
| 1,726,589 | A * | 9/1929 | Schultes | 160/315 |
| 4,372,432 | A * | 2/1983 | Waine et al. | 192/223.4 |
| 4,523,620 | A * | 6/1985 | Mortellite | 160/315 |
| 5,375,643 | A * | 12/1994 | Rude | 160/321 |
| 5,542,464 | A * | 8/1996 | Shiina | 160/296 |
| 6,173,825 | B1 * | 1/2001 | Liu | 192/223.4 |

* cited by examiner

*Primary Examiner*—Blair M. Johnson
(74) *Attorney, Agent, or Firm*—Dowell & Dowell, PC

(57) ABSTRACT

The invention relates to a mechanism comprising at least one spring (3) for compensating the weight of a closing screen, said spring (3) being fixed, at one of its ends (32), to a ring (6) which is rotatably arranged around a shaft (4) having a circular cross-section. A stop spring (7) which is arranged around the shaft (4) ensures a one-way coupling between the ring (6) and the shaft (4), means (8) being provided for controlling the centripetal effort exerted on said shaft (4) by the stop spring (7).

20 Claims, 9 Drawing Sheets

MECHANISM FOR TENSIONING A COMPENSATION SPRING FOR A CLOSING OR SUN PROTECTION INSTALLATION

BACKGROUND OF THE INVENTION

1. Field of the Invention

The invention relates to a mechanism for manoeuvring a closing or sun protection installation. The invention also relates to a closing or sun protection installation incorporating such a mechanism.

2. Brief Description of Related Art

Closing installation is understood to mean doors, portals, blinds, shutters and equivalent equipment.

In a closing or sun protection installation, a screen, which may be a supple shade body or a rigid or semi-rigid panel, is displaced opposite an opening in order to close the latter selectively. The weight of this screen exerts on the drive means a torque which is variable, particularly as a function of the position of this screen. It is known to use so-called "compensating" springs to compensate this torque at least partially.

For an installation to function correctly, it is necessary that the effort of compensation exerted by the spring be adapted to the torque developed by the screen which influences the drive means. This torque is a function of the dimensions of the screen, of its specific weight and of its position with respect to the opening. It is therefore known to provide means for adjusting a compensating spring, particularly when it is initially loaded. U.S. Pat. No. 4,817,927 teaches mounting one end of a compensating spring on a ring capable of rotating about a fixed pin of the installation and immobilizing this ring in rotation with respect to this pin thanks to a screw which, when the tension of the spring is adjusted, must be untightened. This obliges the operator to exert, during such adjustment, a torque on the ring in order to avoid an accidental and sudden unloading of the spring. It is therefore necessary for the operator to manipulate, in one hand, a tool for exerting a torque on the ring and, in the other hand, the locking screw, this involving a particular technical gesture which is not necessarily accessible to a person of little experience.

It is also known, for example from U.S. Pat. No. 4,981,165, to use a wheel and endless screw system for adjusting the position of a ring on which the end of a compensating spring is immobilized. Such a device is relatively complex and expensive.

It is a more particular object of the invention to overcome these drawbacks by proposing a manoeuvring mechanism in which the tension of a compensating spring may be adjusted easily and in safety, by means of a simple and reliable device.

SUMMARY OF THE INVENTION

In this spirit, the invention relates to a mechanism for manoeuvring a closing or sun protection installation, this mechanism being mounted in or on a fixed structure and comprising a screen for closing an opening made in this structure, while it also comprises at least one spring for compensating the weight of this screen, this spring being kinematically connected, by one of its ends, with the afore-mentioned fixed structure and, by its other end, with the afore-mentioned screen. This mechanism is characterized in that it comprises a one-way coupling device including a stop spring disposed between the compensating spring and the fixed structure or between the compensating spring and the screen, while means fast with the compensating spring are arranged to exert on the stop spring an effort of blocking the latter with respect to the fixed structure or to the screen.

Thanks to the use of a stop spring, an automatic blocking in rotation is obtained of the end of the compensating spring connected to the coupling with respect to the fixed structure or to the screen. This blocking is obtained as long as there is no application of a voluntary effort of adjustment aiming at modifying the angular position of this end, i.e. at modifying the tension of the compensating spring. The blocking effort is again exerted as soon as the effort of adjustment ceases, unlike the known devices, for example, from U.S. Pat. No. 4,817,927. The invention therefore proceeds with an original and particularly advantageous use of a lock spring whose functioning is, furthermore, known, for example from FR-A-1 425 353 for other applications.

According to advantageous but non-obligatory aspects of the invention, the mechanism incorporates one or more of the following characteristics:

- The means for exerting the blocking effort comprise a ring disposed, with possibility of rotation, around or partially inside an element of circular cross-section. The ring may be provided with a housing for receiving the two curved ends of the stop spring. This housing is advantageously provided with two surfaces adapted to exert on these ends an effort of relative approach.
- Means are provided for adjusting the intensity of the blocking effort. These means make it possible to reduce or to eliminate the effort exerted by the stop spring and thus to release one of the ends of the compensating spring in order to allow adjustment of its tension. These adjusting means advantageously comprise a ring mounted, with possibility of rotation, around an element of circular cross-section and provided with a projection adapted to be interposed between the curved ends of the stop spring.

In addition, this ring may be provided to present catches or notches for interaction with a tool for controlling its angular position around the circular element. In this way, the tool makes it possible to exert on the ring an effort of rotation about the element of circular cross-section, this effort being transmitted by the projection to one or the other of the curved ends of the stop spring, this having the effect of expanding the latter by releasing the ring fast with the compensating spring which may in that case rotate in the desired direction. In a variant, the afore-mentioned adjusting means may comprise a shaft provided with a radial projection adapted to be interposed between the curved ends of the stop spring.

- According to a first form of embodiment, the circular element is a fixed central shaft extending over substantially the whole width of the opening to be closed.
- According to another embodiment, the circular element is a casing of a device for driving in rotation a member winding the closing screen or an associated effort transmission element.
- The blocking effort is centripetal and exerted on the element of circular cross-section.
- According to a variant embodiment of the invention, the element of circular cross-section surrounds the stop spring and a part of the ring exerting the blocking effort, this effort being centrifugal and exerted on the element of circular cross-section.
- The spring, the ring, the circular element and the control means may be at least partially housed inside a shaft for winding the closing screen or an associated effort transmission element. In that case, this winding shaft is advantageously provided with at least one opening giving access to the control means, particularly by an appropriate tool.

The invention finally relates to a closure/sun protection installation which comprises a mechanism as described previously. Such an installation is reliable and economical, while it offers the possibility of an easy adjustment of the tension of a compensating spring that it includes, without danger, on its site of use.

The invention will be more readily understood and other advantages thereof will appear more clearly in the light of the following description of seven forms of embodiment of a closing installation according to the invention, given solely by way of example and made with reference to the accompanying drawings, in which:

DETAILED DESCRIPTION OF PREFERRED EMBODIMENTS

Figure 1:
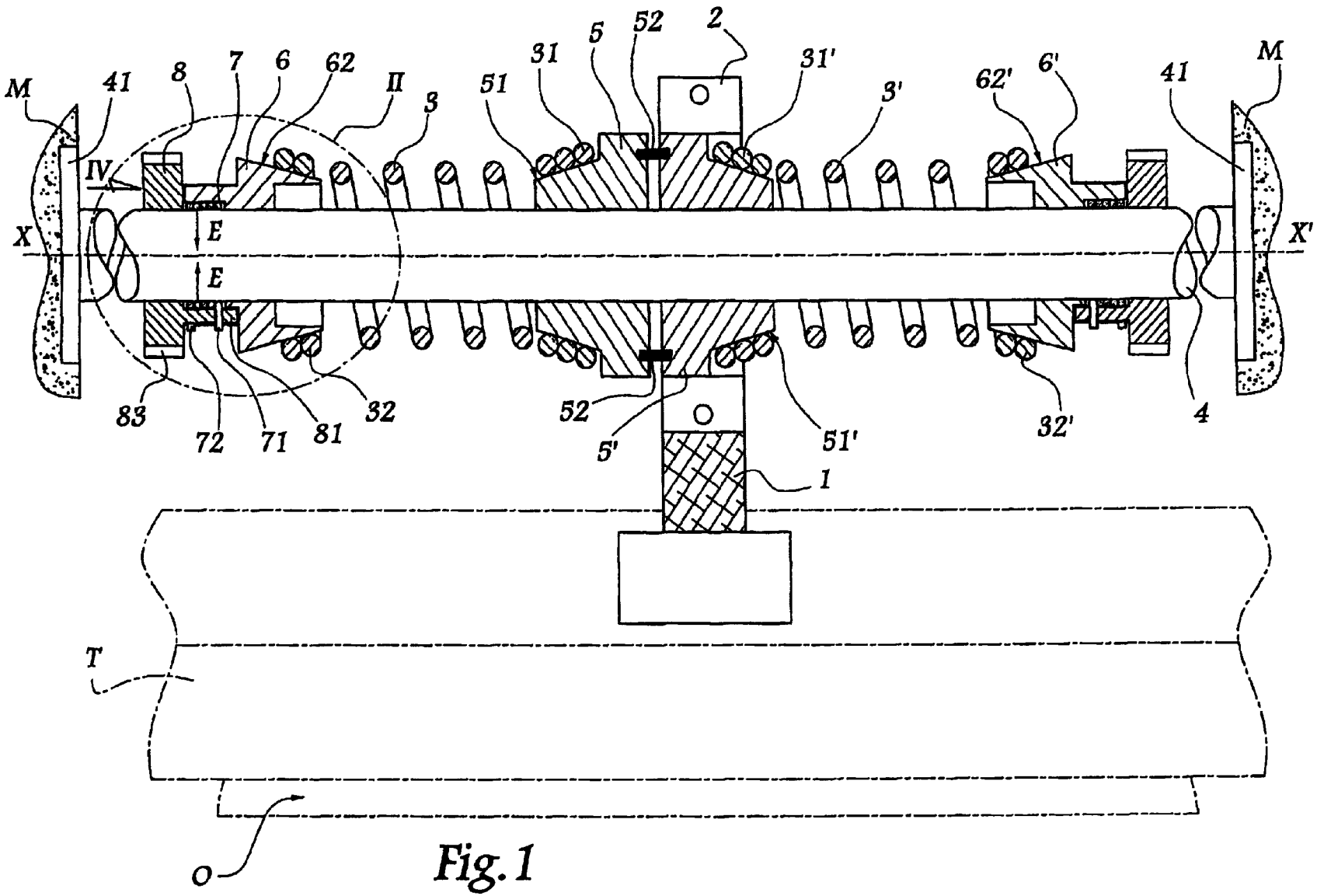
FIG. 1 is a partial longitudinal section of an installation in accordance with a first form of embodiment of the invention.

The installation shown in FIGS. 1 to 4 comprises a screen body T intended to be selectively wound around a substantially horizontal geometrical axis X-X' fixed with respect to the masonry M of a building in which is made an opening O to be closed with the screen body T. The screen body T is connected by a plurality of straps, of which only one is visible in FIG. 1 with reference 1, to winding discs of which only one is visible in FIG. 1 with reference 2. Two compensating springs 3 and 3' are mounted to exert on the disc 2 an effort opposite the torque resulting from the weight of the screen body T with respect to the axis X-X'. The discs 2 and equivalent are mounted to rotate freely around a shaft 4 of circular cross-section which is fixed, thanks to brackets 41, with respect to the masonry M.

Means for driving the screen body T in rotation about axis X-X' may be provided, such drive means being able to be mechanical or electrical. As a variant, the screen body T is controlled by a direct action of the user on the lower slat thereof.

The springs 3 and 3' are each immobilized on the truncated surface 51 or 51' of two rings 5 and 5' rendered fast by keys 52, the ring 5' being in mesh with the disc 2. In practice, a first end 31 or 31' of a spring 3 or 3' is wound on a surface 51 or 51', a hook possibly being formed in order to anchor these ends firmly with respect to the rings 5 and 5'.

At the level of their respective opposite ends 32 and 32', the springs 3 and 3' are immobilized on rings 6 and 6' which each comprise a truncated surface 62 and 62' for receiving the ends 32 and 32'.

Figure 2:
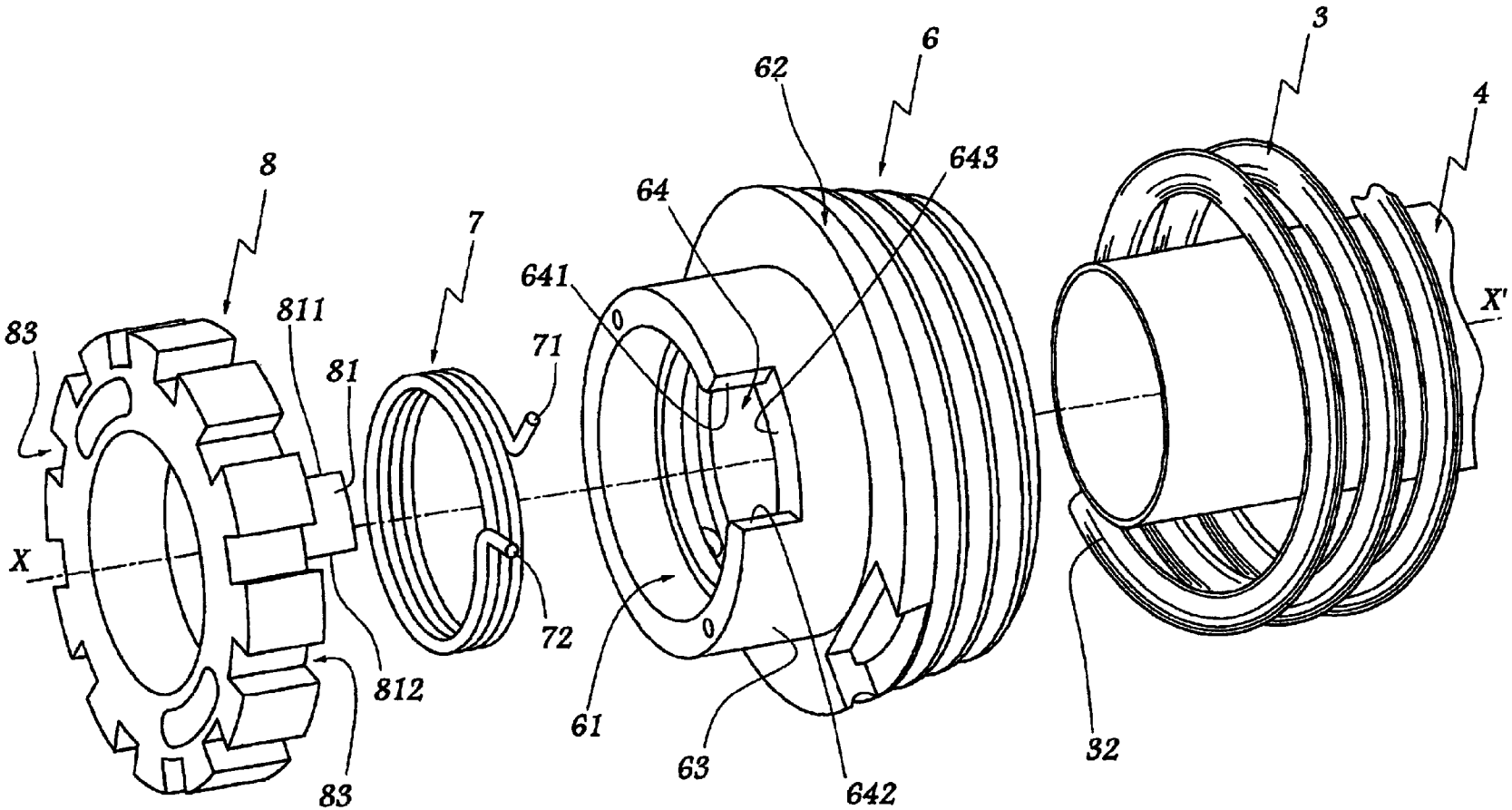
FIG. 2 is an exploded view in perspective of the elements shown in detail II in FIG. 1.
Figure 3:
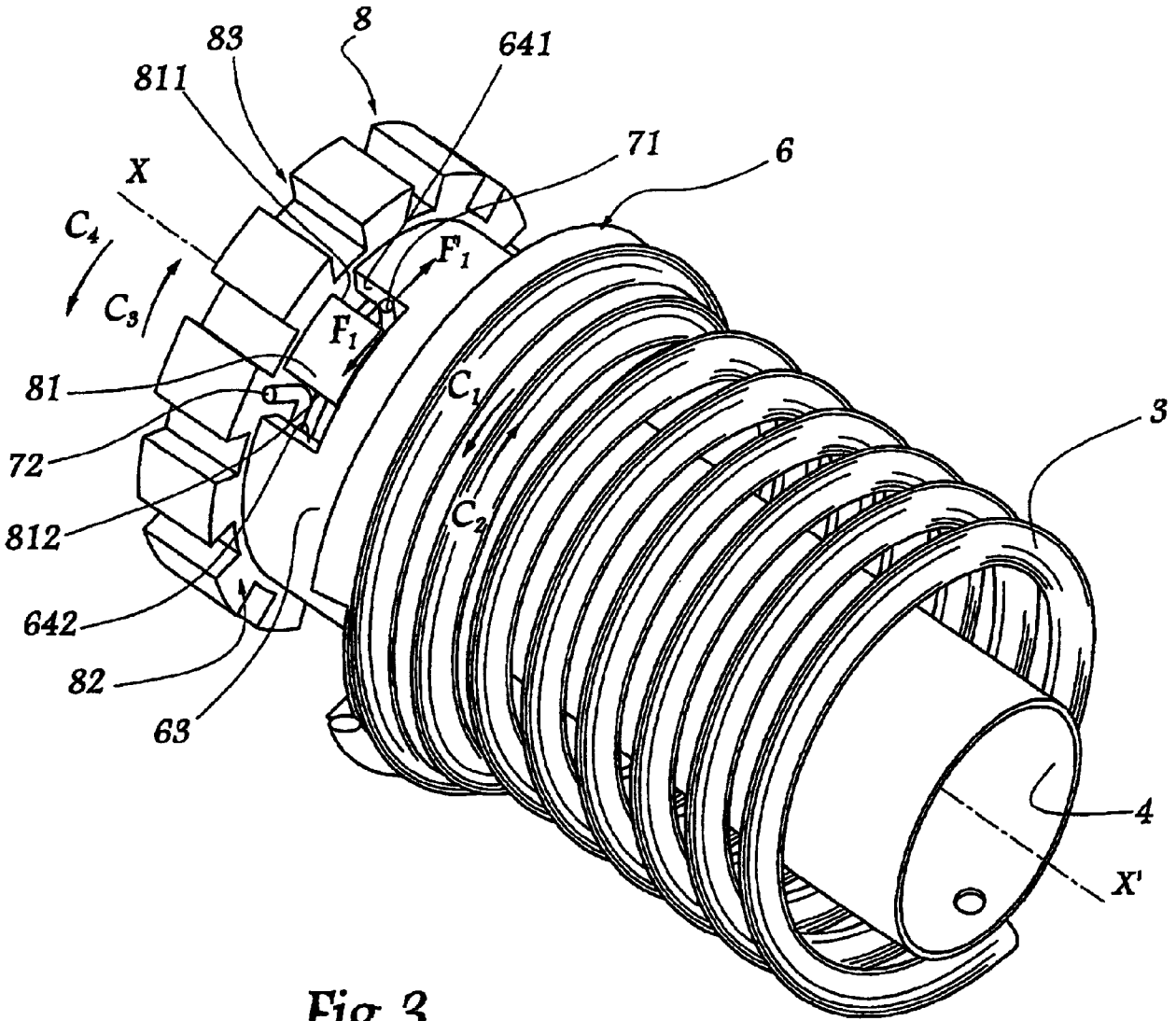
FIG. 3 is a view in perspective of the elements shown in FIG. 2 seen from another angle.

As is visible in FIGS. 2 and 3, the ring 6 is provided with a central opening 61 of circular shape, whose diameter allows it to rotate about the shaft 4. The surface 62 is stepped in order to facilitate positioning of the end 32 of the spring 3. The ring 6 also comprises a sleeve 63 in which is formed a notch 64 of which 641 and 642 denote the lateral edges and 643 the bottom edge.

A spring 7 is disposed around the shaft 4 and inside the sleeve 63. 71 and 72 denote the ends of the spring 7 which is a stop spring in that it is adapted to brake the ring 6 with respect to the shaft 4, i.e., in practice, to immobilize the ring 6 in rotation about axis X-X' thanks to a centripetal effort E.

A second ring 8 is also mounted around the shaft 4, with possibility of rotation, this ring being provided with a projection 81 which extends, with respect to a side 82 of the ring 8, in a direction substantially parallel to axis X-X'. The projection 81 has a width allowing it to be inserted between the ends 71 and 72 of the stop spring 7, while the notch 64 has a width allowing it to receive the ends 71 and 72 between the edges 641 and 642.

The ring 8 is also provided with a plurality of peripheral grooves 83 which make it possible easily to exert on the ring 8 a torque with respect to axis X-X'.

Functioning is as follows:

By default, and in the absence of action on the ring 8, when a torque $C_1$ is exerted on the ring 6 by the spring 3 due to its loading, this torque $C_1$ has the effect of displacing the edge 641 of the notch 64 up to contact with the end 71 of the spring 7, the edge 641 in that case exerting on the end 71 an effort $F_1$ directed towards the edge 642, this having the effect of tightening the spring 7 on the shaft 4, increasing the intensity of the centripetal effort E of blocking of the spring 7 on the shaft 4. The movement of the ring 6 is thus limited by its interaction with the end 71.

If a torque $C_2$ directed in opposite direction with respect to torque $C_1$ is exerted by the spring 3 on the ring 6, this torque is translated by a displacement of the edge 642 up to contact with the end 72 of the spring 7 and, as previously, by a tightening of this spring on the shaft 4 and by an increase in the centripetal effort of blocking E.

In this way, the stop spring 7 makes it possible to immobilize the ring 6 on the shaft 4, despite the torques $C_1$ or $C_2$ transmitted by the spring 3.

However, it is possible to rotate the ring 6 about axis X-X' in order to adjust the tension of the spring 3. In effect, when a torque $C_3$ is exerted on the ring 8 towards the right in FIG. 3, this has the effect of bringing an edge 811 of the projection 81 up to contact with the end 71 of the spring 7, then of exerting on this end an effort $F'_1$ opposite the effort $F_1$ previously mentioned, this effort $F'_1$ having the effect of radially expanding the spring 7 which then releases its centripetal effort E on the shaft 4. It is thus possible to rotate, in the direction of torque $C_3$, both the ring 8, the spring 7 and the ring 6, this having the effect of modifying the tension of the spring 3.

An adjustment in opposite direction may be obtained by exerting a torque $C_4$, directed in the direction opposite to torque $C_3$. The effort $C_4$ induces a displacement of the opposite edge 812 of the projection 81 up to contact with the end 72, then a displacement of this end in the direction of edge 641, this having the effect of expanding the spring 7 and thus of allowing the drive of the ring 6 in the direction of the torque $C_4$.

Figure 4:
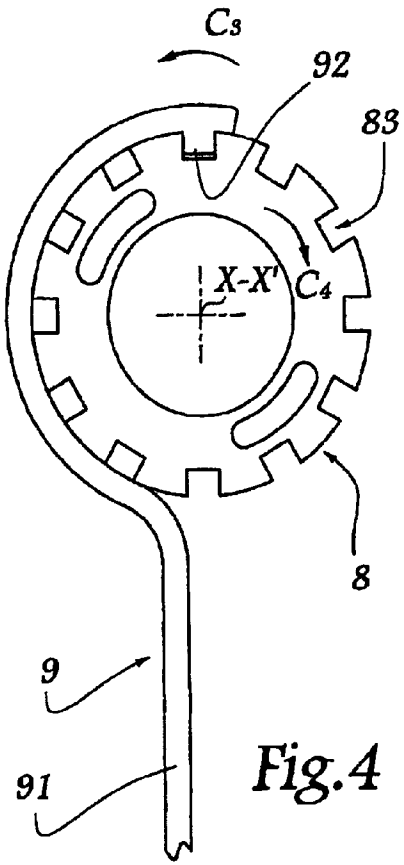
FIG. 4 is a view in the direction of arrow IV in FIG. 1, while the tension of a compensating spring is being adjusted.

As shown in FIG. 4, a spanner 9 may be used for exerting the torque $C_3$ thanks to an effort $F_3$ exerted on its handle 91. The spanner 9 is provided with a nose 92 adapted to penetrate in one of the grooves 83. When the torque $C_4$ must be applied, the spanner 9 is returned and an effort in direction opposite the effort $F_3$ is exerted on the handle 91.

According to a variant of the invention (not shown), the structure shown in FIGS. 1 to 4 may be modified so that the rings 5 and 5' are fixed on a bracket mounted on the fixed structure of the building, the shaft 4 in that case being rotating and bearing at its ends pulleys on which is wound a hoisting cable connected to the screen body T. For the rest, functioning is the same as that mentioned hereinabove.

Figure 5:
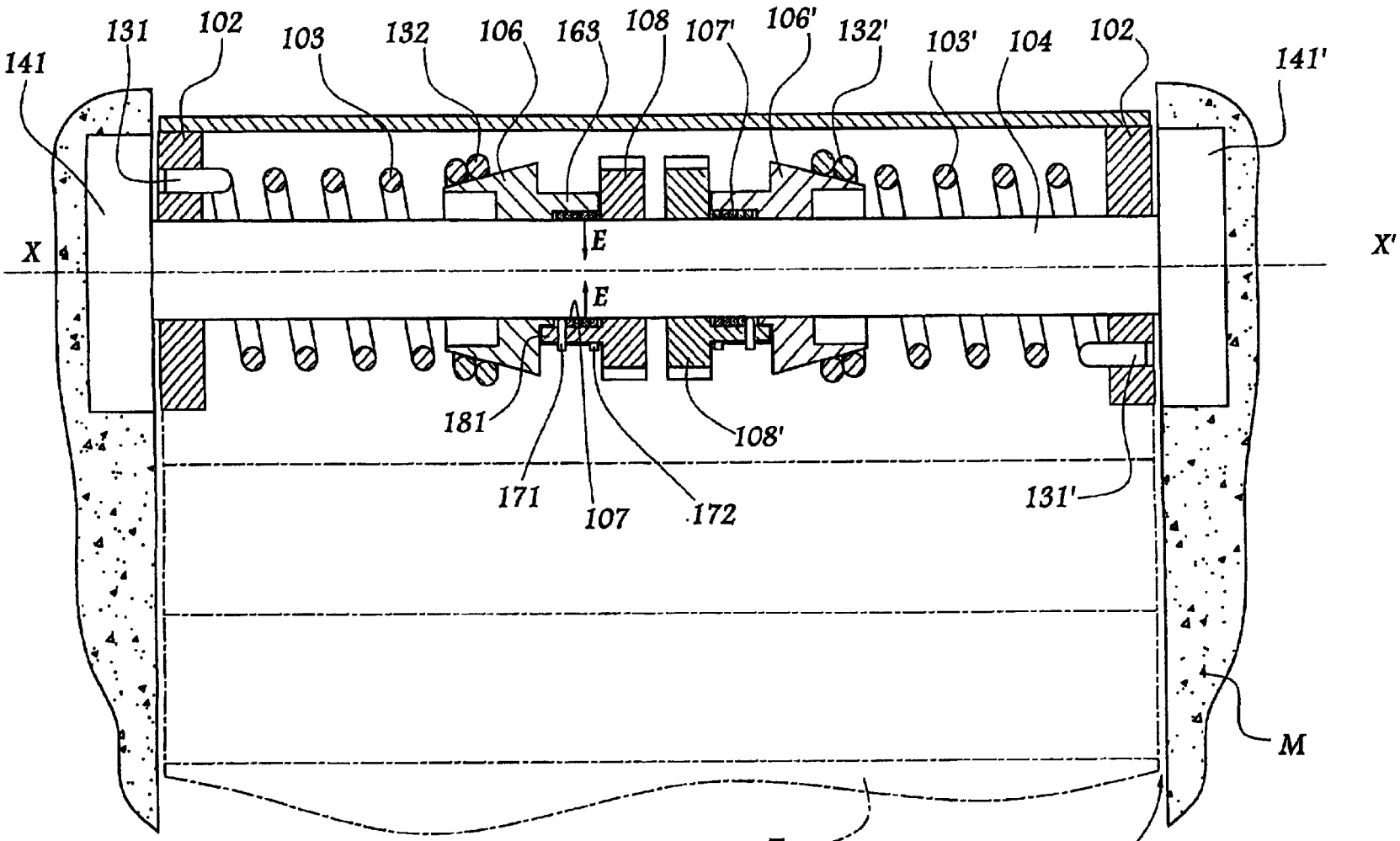
FIG. 5 is a longitudinal section of an installation in accordance with a second form of embodiment of the invention.

In the second form of embodiment of the invention shown in FIG. 5, elements similar to those of the first embodiment bear identical references increased by 100. In this installation, a fixed shaft 104 is immobilized with respect to the masonry M of a building thanks to brackets 141 and 141'. X-X' denotes the longitudinal axis of the shaft 104. Two discs 102 and 102' are mobile in rotation about the shaft 104 and axis X-X' and allow the controlled winding of a screen body T intended to close an opening O.

Two compensating springs 103 and 103' each have a first end 131 or 131' fast with a disc 102 or 102' and a second end 132 or 132' fast with a ring 106 or 106' mounted, with possibility of rotation, on shaft 104. As previously, the ring 106 forms a sleeve 163 inside which is disposed a stop spring 107 of which the ends 171 and 172 are provided to interact with a projection 181 in one piece with a ring 108 mounted, with possibility of rotation, about the shaft 104. The centripetal effort E exerted by the spring 107 on the shaft 104 may, as previously, be controlled thanks to the ring 108.

An equivalent structure is provided at the level of the ring 106' which is associated with a stop spring 107' and with a control ring 108'.

Figure 6:
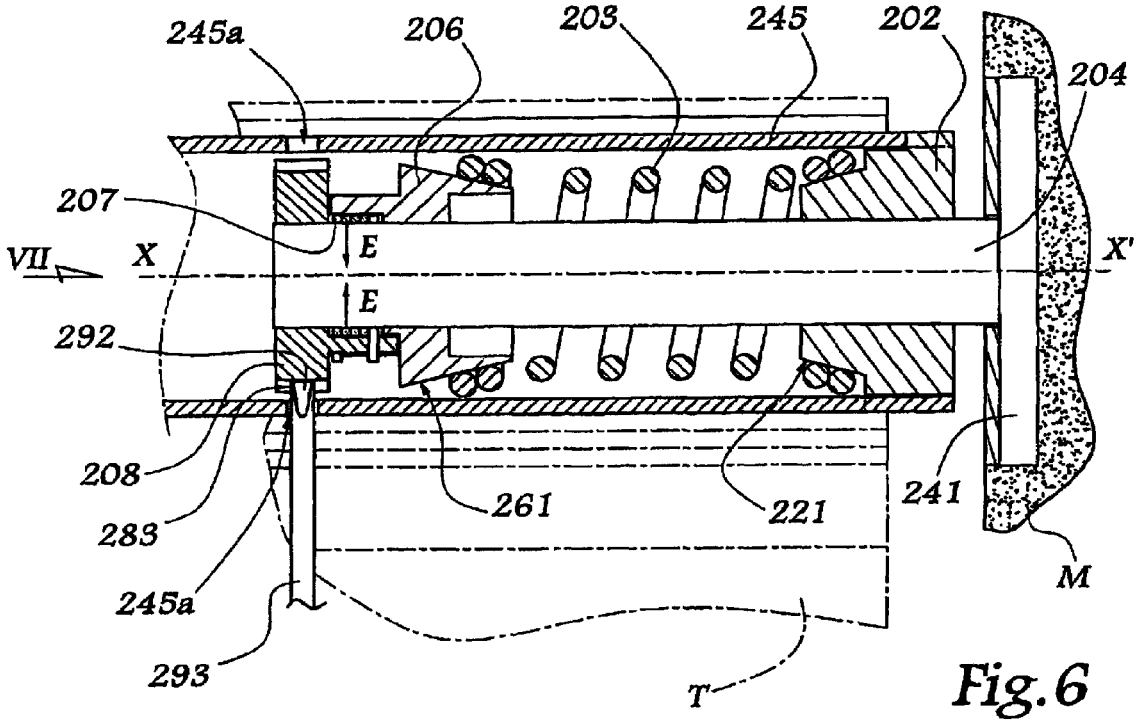
FIG. 6 is a view similar to FIG. 1 for an installation in accordance with a third form of embodiment of the invention.
Figure 7:
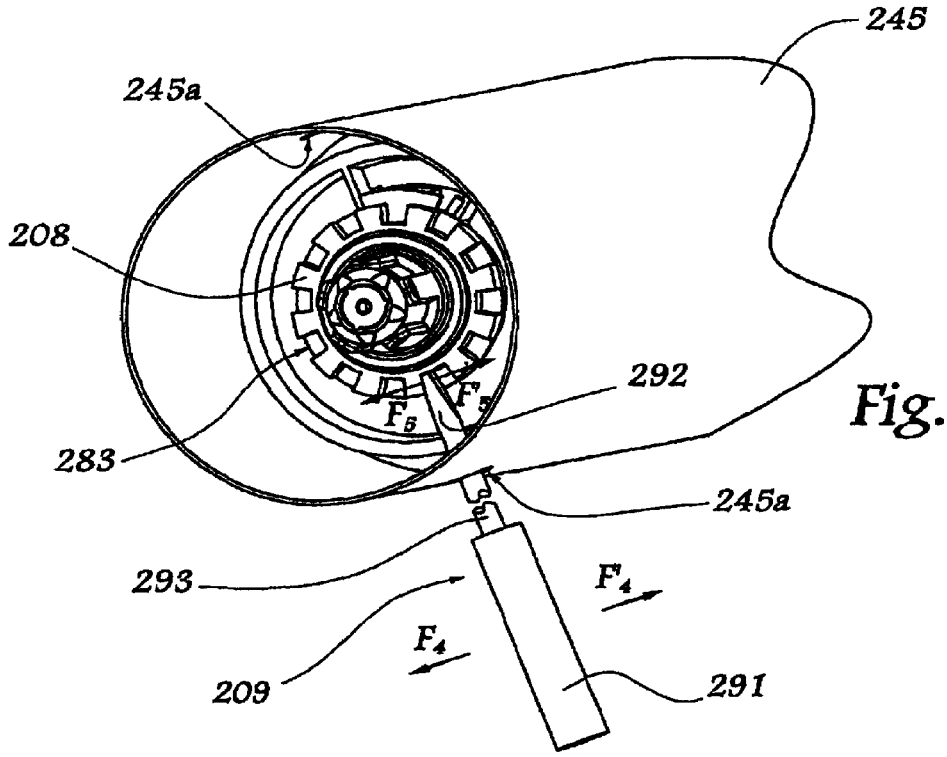
FIG. 7 is a view in perspective of a part of the installation of FIG. 6, while the tension of a compensating spring is being adjusted.

In the third form of embodiment of the invention shown in FIGS. 6 and 7, elements similar to those of the first embodiment bear identical references increased by 200. In this embodiment, the screen body T of an installation may be selectively wound around a horizontal axis X-X' which is a central axis of a fixed, circular shaft 204, this shaft being supported by a bracket 241 fixed on the masonry M of a building.

A spacer disc 202 supports a hollow tube 245 around the shaft 204. An equivalent disc is provided on the opposite side of the installation, this making it possible to maintain the tube 245 in a position centred on the axis X-X', with possibility of rotation, for the selective winding of the screen body T.

A compensating spring 203 is more or less tightened between a truncated surface 221 of the disc 202 and a truncated surface 261 of a ring 206 similar to rings 6 and 106 of the first and second embodiments. A stop spring 207 and a control ring 208 are associated with the ring 206, this making it possible to control the centripetal effort E exerted by the spring 207 on the shaft 204. The ring 208 is provided with notches 283 in which a manoeuvring member such as the end 292 of a screwdriver 209 may be introduced. To that end, the tube 245 is provided with an orifice **245*a* in which the tip 292 can be introduced. It is thus possible to exert on the handle 291 of the screwdriver 209 an effort $F_4$ or $F'_4$ such that the shank 293 of the screwdriver 209 pivots about its point of abutment on the edge of the orifice 245*a*, with the result that a corresponding effort $F_5$ or $F'_5$ is exerted in one of the notches 283. This has the effect of rotating the ring 208 and, as previously, of expanding the spring 207, of driving the ring 206 and of loading the spring 203** more or less.

Figure 8:
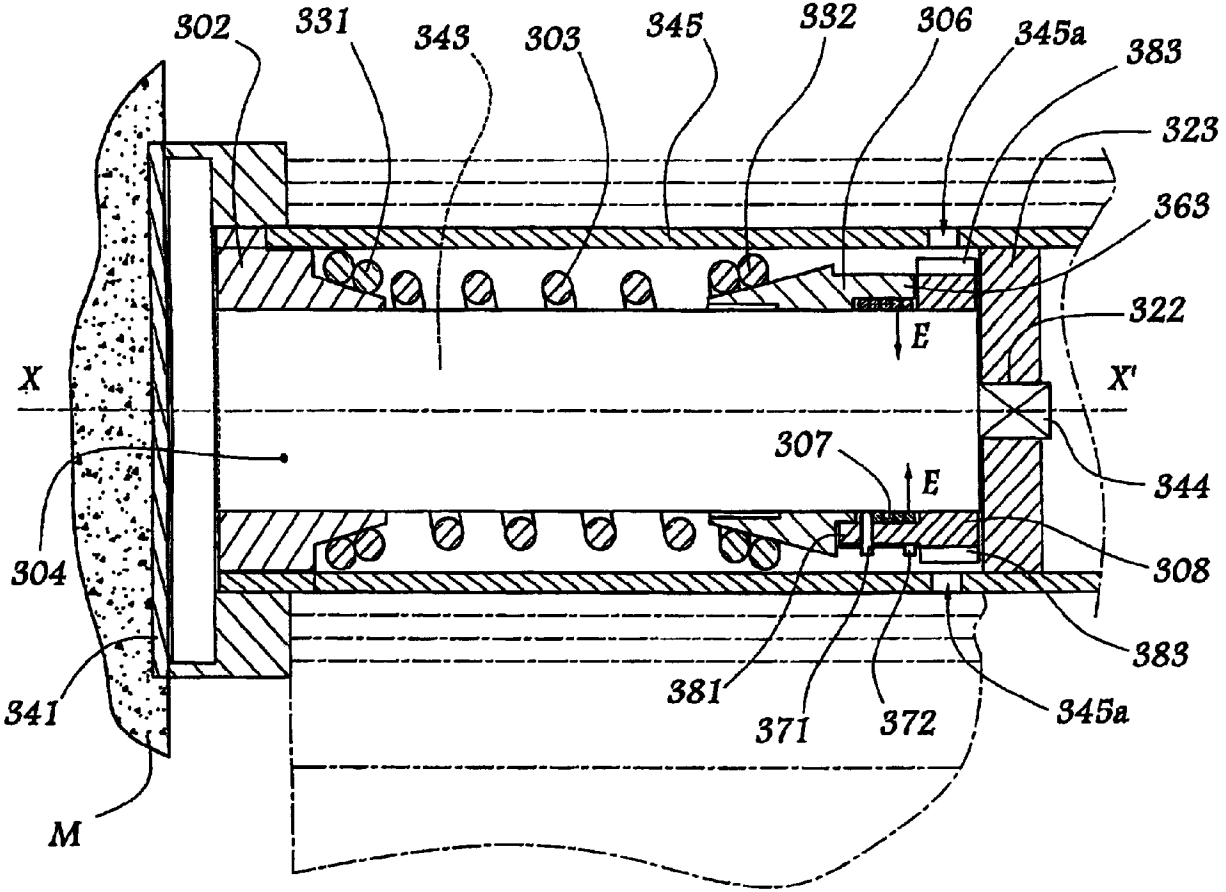
FIG. 8 is a view similar to FIG. 6 for an installation in accordance with a fourth form of embodiment of the invention.

In the fourth form of embodiment of the invention shown in FIG. 8, elements similar to those of the first embodiment bear identical references increased by 300. In this embodiment, an electric gear-motor 343 is housed in a casing 304 of circular cross-section which is fixed with respect to the masonry M of a building thanks to a bracket 341. The output shaft 344 of the gear-motor 343 is inserted in a central opening 322 of a disc 323 for driving in rotation a hollow tube 345 forming shaft for winding the screen body T of the installation, about a geometrical axis X-X' which is the central axis of the casing 304.

A circular distance piece 302 is fast in rotation with the tube 345 and mounted, with possibility of rotation, about the casing 304.

A compensating spring 303 is disposed around the casing 303, inside the tube 345. This spring 303 is fixed by one of its ends 331 on the distance piece 302 and by its other end 332 on a ring 306 similar to the rings 6, 106 and 206 of the preceding embodiments. A stop spring 307 is disposed around the casing 304 inside a sleeve 363 formed by the ring 306. The curved ends 371 and 372 of the spring 307 are capable of interacting with a projection 381 of a control ring 308 mounted, with possibility of rotation, about the casing 304. It is thus possible to influence the intensity of the centripetal effort E exerted by the spring 307 on the casing 304.

The tube 345 is provided with a plurality of orifices **345*a* making it possible to access grooves 383 made on the outer radial surface of the ring 308, this in order to control the angular position of the ring 308 about axis X-X' and to drive, after radial expansion of the spring 307, the ring 306 in rotation about axis X-X' in order to load the spring 303** more or less.

Figure 9:
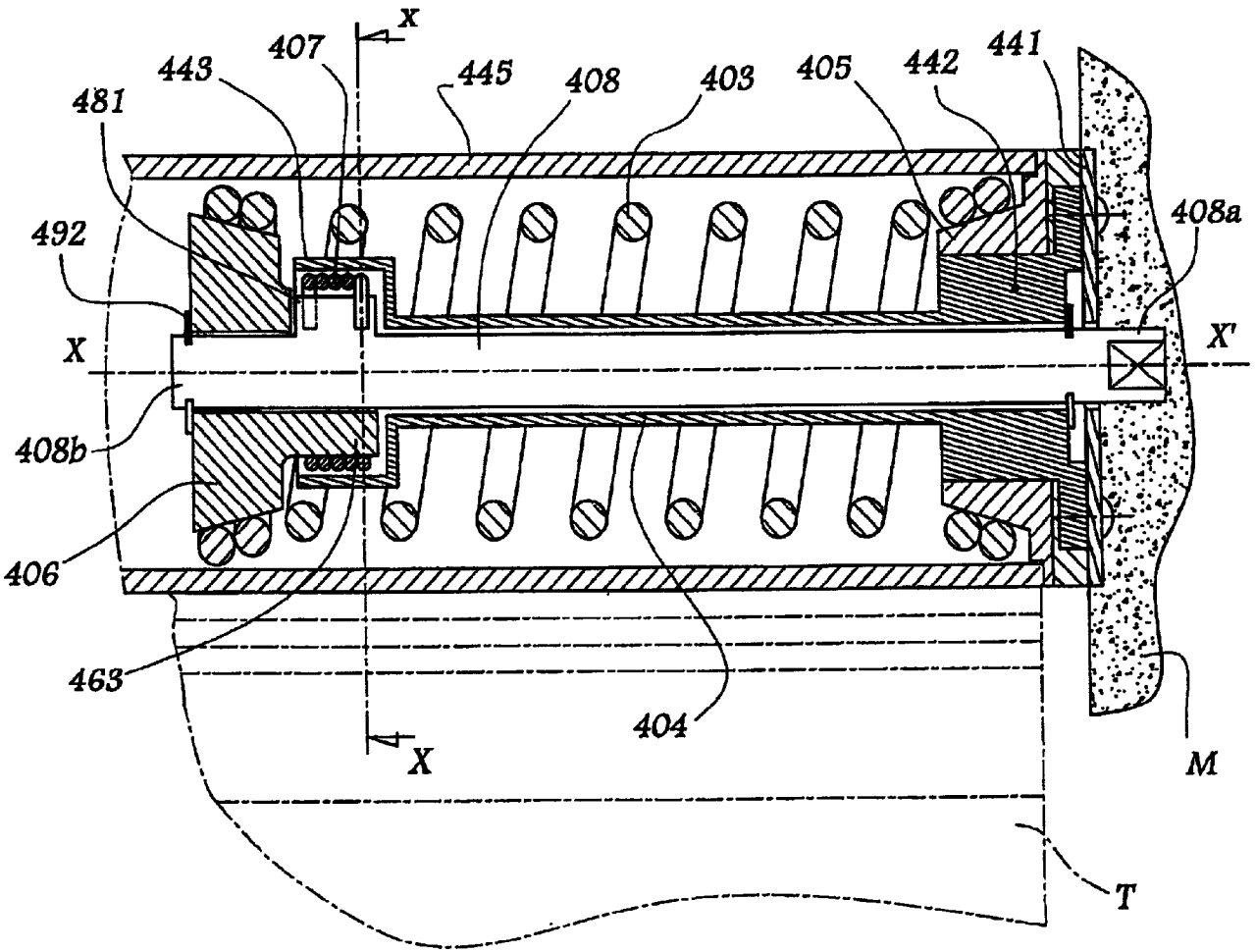
FIG. 9 is a view similar to FIG. 6 for a mechanism in accordance with a fifth form of embodiment of the invention.
Figure 10:
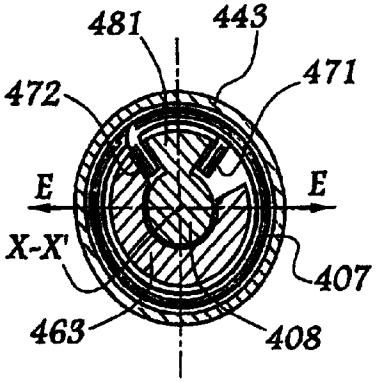
FIG. 10 is a section along line X-X in FIG. 9.

In the fifth form of embodiment of the invention shown in FIGS. 9 and 10, elements similar to those of the first embodiment bear identical references increased by 400. In this embodiment, the screen body T of an installation may be selectively wound around a horizontal axis X-X' which is a central geometrical axis of a hollow tube 445. The hollow tube is fast in rotation with a ring 405 mounted to pivot, about axis X-X' on a support 442 fixed on a bracket 441 immobilized with respect to the masonry M of the building.

A shaft 408 extends substantially along axis X-X', passing through the elements 441 and 442 and is equipped, at the level of a first end **408*a*, with a drive block adapted to cooperate with a spanner, a crank or any other means for controlling the rotation of the shaft 408**.

At the level of its end **408*b* opposite the end 408*a*, the shaft 408 is surrounded by a ring 406 that may rotate, with a limited angular clearance, about the end 408*b*. A snap ring 492 makes it possible to immobilize the ring 406 axially on the shaft 408. The shaft 408 is provided with a radial projection 481, while the ring 406 forms a sleeve 463 which partially surrounds the shaft 408, with the exception of the projection 481. The elements 463 and 481 are arranged inside a dish 443 extending a hollow shaft 404 fast with the support 442**.

A stop spring 407 is disposed between the elements 463 and 481, on the one hand, and the dish 443, on the other hand. 471 and 472 respectively denote the ends of the spring 407.

A compensating spring 403 is disposed between the rings 405 and 406, being fast in rotation with each of them.

As a function of the torque transmitted by the spring 403, the ring 406 exerts on one of the ends 471 or 472 an effort which is translated by a centrifugal expansion of the spring 407, such expansion inducing a centrifugal effort E for blocking the spring 407 with respect to the dish 443, i.e. through it and through the shaft 404 with respect to the support 442 and the masonry M of the building.

When the tension of the spring 403 is to be adjusted, it suffices to rotate with the crank 491 the shaft 408 of which the projection 481 exerts on one of the ends 471 or 472 an effort such that the spring is compressed, to such a point that it is possible to rotate the elements 406 to 408 inside the dish 443.

Figure 11:
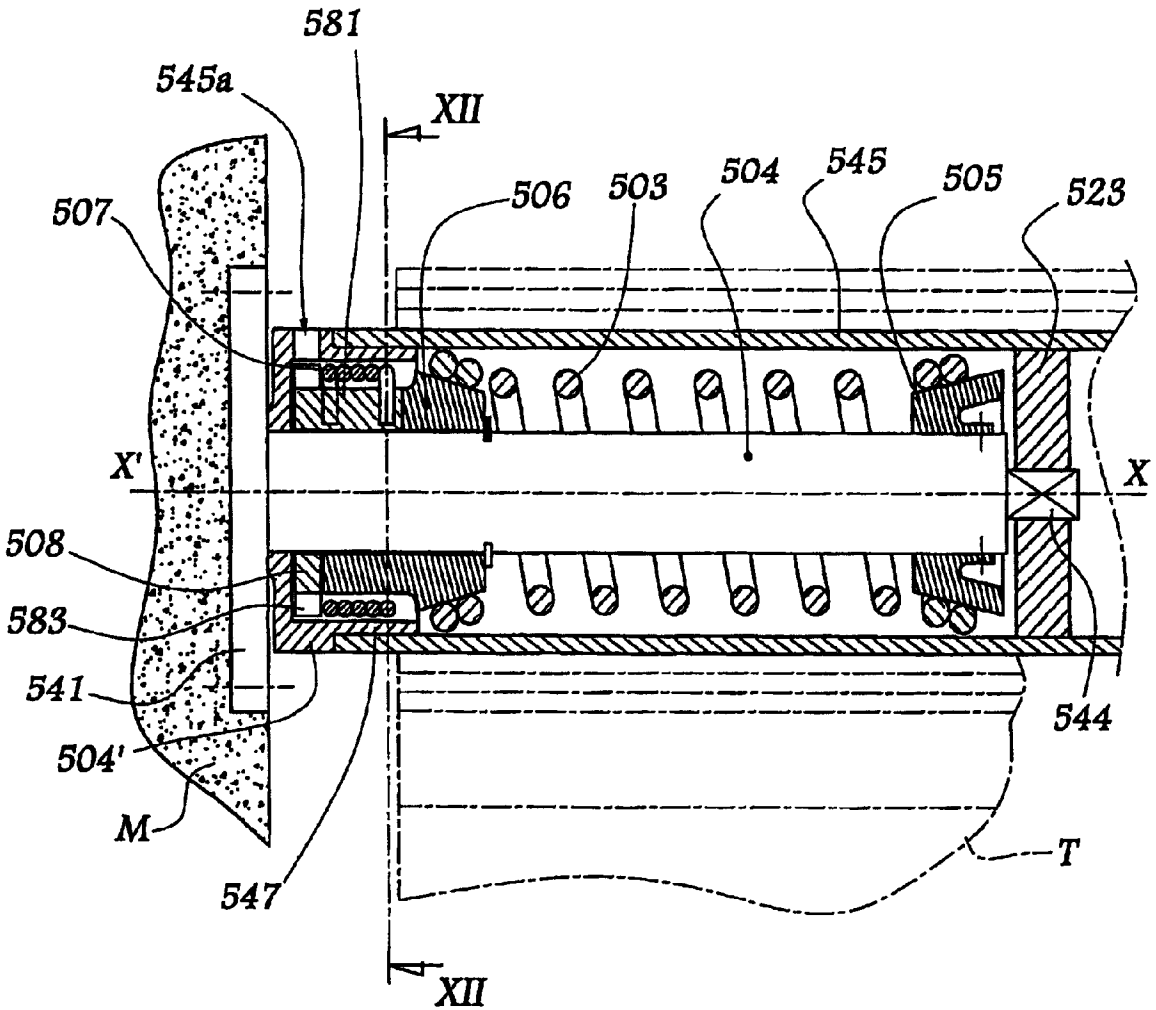
FIG. 11 is a view similar to FIG. 6 for a mechanism in accordance with a sixth form of embodiment of the invention.
Figure 12:
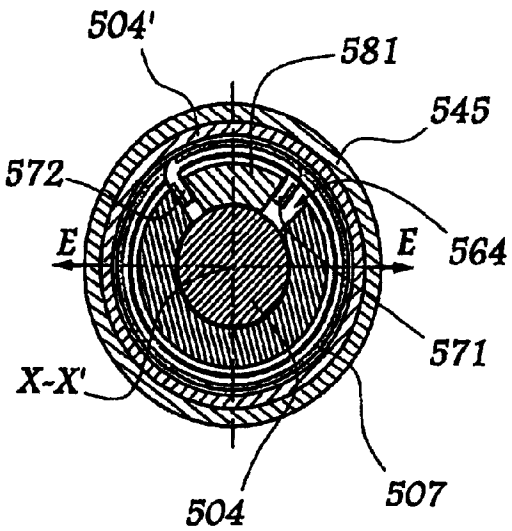
FIG. 12 is a section along line XII-XII in FIG. 11.

In the sixth form of embodiment of the invention shown in FIGS. 11 and 12, elements similar to those of the first embodiment bear identical references increased by 500. In this embodiment, the screen body T of a closing installation may be selectively wound about a horizontal axis X-X' on which is centred a hollow tube 545 for winding a screen body T.

As previously, a bracket 541 is fixed with respect to the masonry M of a building, this bracket supporting a casing 504 enclosing the same elements are the casing 304 of the fourth embodiment. An output shaft 544 of the casing 504 is fast with a disc 523 for driving the tube 545 in rotation. A ring 505 is fixed in rotation around the end of the casing 504 most remote from the bracket 541, while a second ring 506 is mounted about the end of this casing closest to the bracket with possibility of rotation.

A compensating spring 503 is tightened between the rings 505 and 506, while a third ring 508 is mounted, with possibility of rotation, about the casing 504, in the vicinity of the ring 506. The ring 508 is provided with a projection 581 adapted to be engaged in a notch 564 formed by the ring 506. A ring 504' fast with the tube 545 is also mounted, with possibility of rotation and in the vicinity of the ring 506, around the casing 504, this ring 504' forming a sleeve 547 which surrounds at least partially the rings 508 and 506, as well as a stop spring 507 whose ends 571 and 572 are engaged in the notch 564, on either side of the end 581. The functioning is similar to that envisaged previously, the ring 508, accessible through one or more openings 545*a* made in the ring 504', being provided with peripheral elements in relief 583 such as grooves making it possible to control the intensity of the centrifugal blocking effort E exerted by the spring 507 on the ring 504' fast with the tube 545.

It should be noted that this form of embodiment differs from the preceding ones insofar as the one-way coupling, which comprises a stop spring, is integrated between the compensating spring 503 and the screen body T and not between this spring and the masonry M, as in the preceding cases.

Figure 13:
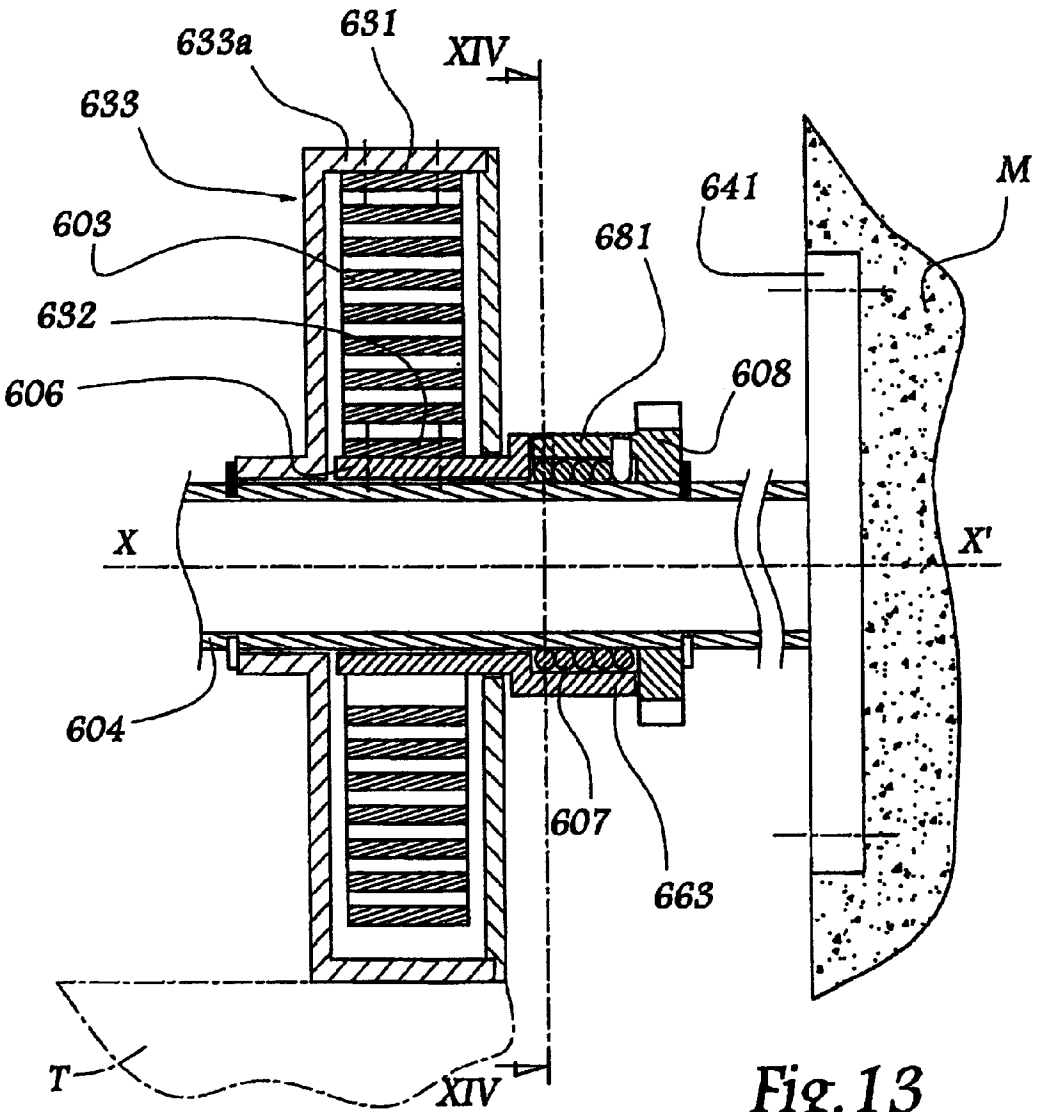
FIG. 13 is a partial longitudinal section of a mechanism in accordance with a seventh form of embodiment of the invention.
Figure 14:
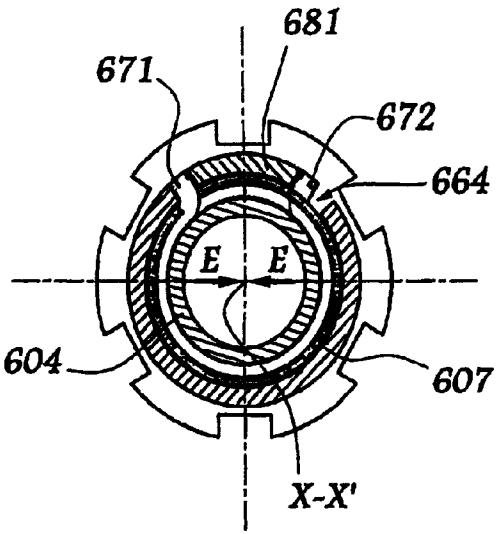
FIG. 14 is a section along line XIV-XIV in FIG. 13.

The seventh form of embodiment of the invention shown in FIGS. 13 and 14 concerns an application of the invention to the case of a spring box 633 being used for containing a spring 603 for compensating the weight of a screen body T intended to be wound around a horizontal axis X-X' also forming axis of symmetry of a tube 604 supported by a bracket 641 immobilized with respect to the masonry M of a building. One end 631 of the spring 603 is fast with the casing 633*a* of the box 633 which rotates about axis X-X' when the screen body T is being wound or unwound. Furthermore, the second end 632 of the spring 603 is fast with a ring 606 mounted to pivot about the shaft 604 and which extends by a sleeve 663 also surrounding the shaft 604 and inside which is disposed a stop spring 607 of which the curved ends 671 and 672 extend in a notch 664 made in the sleeve 663. A ring 608 provided with a projection 681 engaged in the notch 664 makes it possible, as previously, to control the intensity of a centripetal effort E directed towards axis X-X' and exerted by the stop spring 607.

The characteristics of the different forms of embodiment described may be combined together without departing from the scope of the present invention. Similarly, obvious modifications may be made to the forms of embodiment described.

The invention claimed is:

1. A mechanism for manoeuvring a closing or sun protection installation, said mechanism connected to a fixed structure and comprising:

a screen for closing an opening made in the fixed structure;

at least one compensating spring for compensating a weight of said screen, said spring being, in normal functioning of the installation, kinematically connected, by a first end, with the fixed structure and, by a second end, with said screen; and a coupling device including a stop spring disposed between said compensating spring and said fixed structure and a first mounting means to which one end of said compensating spring is kinematically linked to exert on said stop spring a centripetal or centrifugal effort (E) of blocking said stop spring with respect to the fixed structure.

2. The mechanism according to claim 1, wherein said first mounting means includes a ring connected to an element of circular cross-section.

3. The mechanism according to claim 2, wherein said stop spring has a first end and a second end, and wherein said ring has a housing for receiving said ends of said stop spring.

4. The mechanism according to claim 3, wherein said housing is provided with two surfaces, said surfaces adapted to exert on said ends of said stop spring an effort ($F_1$) of relative approach.

5. The mechanism according to claim 1, further comprising a second mounting means for adjusting a tension of said compensating spring.

6. The mechanism according to claim 5, wherein said second mounting means for adjusting a tension of said compensating spring includes a ring connected to an element of circular cross-section, said ring having a projection adapted to be interposed between said ends of said stop spring.

7. The mechanism according to claim 6, wherein said ring further has notches adapted to interact with a tool to control an angular position of said ring relative to said element.

8. The mechanism according to claim 5, wherein said second mounting means for adjusting a tension of said compensating spring includes a shaft having a radial projection adapted to be interposed between said ends of said stop spring.

9. The mechanism according to claim 2, wherein said element of circular cross-section is a fixed central shaft extending over substantially a width of the opening to be closed by said screen.

10. The mechanism according to claim 2, wherein said element of circular cross-section is a casing of a device for driving in rotation a member for winding said screen.

11. The mechanism according to claim 2, wherein the blocking effort (E) is centripetal and exerted on said element of circular cross-section.

12. The mechanism according to claim 2, wherein said element of circular cross-section surrounds said stop spring and at least a part of said ring, and wherein the blocking effort (E) is centrifugal and exerted on said element of circular cross-section.

13. The mechanism according to claim 2, further comprising a second mounting means for adjusting a tension of said compensating spring, wherein said stop spring, said ring, said element of circular cross-section, and said second mounting means for adjusting a tension of said compensating spring are at least partially housed inside a shaft for winding said screen.

14. The mechanism according to claim 13, wherein said shaft includes at least one opening for providing access to said second means for adjusting a tension of said compensating spring by a tool.

15. A closing or sun protection installation comprising a mechanism, said mechanism including:

a screen for closing an opening made in a fixed structure;

at least one compensating spring for compensating a weight of said screen, said spring being, in normal functioning of the installation, kinematically connected, by a first end, with the fixed structure and, by a second end, with said screen; and a coupling device having a stop spring disposed between said compensating spring and said fixed structure and a first mounting means to which one end said compensating spring is kinematically linked to exert on said stop spring a centripetal or centrifugal effort (E) of blocking said stop spring with respect to the fixed structure.

16. A mechanism for manoeuvring a closing or sun protection installation, said mechanism connected to a fixed structure and comprising:

a screen for closing an opening made in the fixed structure;

at least one compensating spring for compensating a weight of said screen, said spring being, in normal functioning of the installation, kinematically connected, by a first end, with the fixed structure and, by a second end, with said screen; and a coupling device including a stop spring disposed between said compensating spring and said screen and a first mounting to which one end of said compensating spring is kinematically linked to exert on said stop spring a centripetal or centrifugal effort (E) of blocking said stop spring with respect to said screen.

17. A closing or sun protection installation comprising a mechanism, said mechanism including:

a screen for closing an opening made in the fixed structure;

at least one compensating spring for compensating a weight of said screen, said spring being, in normal functioning of the installation, kinematically connected, by a first end, with the fixed structure and, by a second end, with said screen; and a coupling device having a stop spring disposed between said compensating spring and said screen and a first mounting means to which one end said compensating spring is kinematically linked to exert on said stop spring a centripetal or centrifugal effort (E) of blocking said stop spring with respect to said screen.

18. The mechanism according to claim 16, further comprising a second mounting means for adjusting a tension of said compensating spring, said second mounting means including a ring connected to an element of circular cross-section, said ring having a projection adapted to be interposed between said ends of said stop spring.

19. A mechanism for manoeuvring a closing or sun protection installation, said mechanism connected to a fixed structure and comprising:

a screen for closing an opening made in the fixed structure;

at least one compensating spring for compensating a weight of said screen, said spring being, in normal functioning of the installation, kinematically connected, by a first end, with the fixed structure and, by a second end, with said screen;

a coupling device including a stop spring disposed between said compensating spring and said fixed structure and a first mounting means to which one end of said compensating spring is kinematically linked to exert on said stop spring an effort CE) of blocking said stop spring with respect to the fixed structure; and a second mounting means for adjusting a tension of said compensating spring, said second mounting means acting against said blocking effort (E) in order to allow selective adjustment of the tension of said compensating spring.

20. A mechanism for manoeuvring a closing or sun protection installation, said mechanism connected to a fixed structure and comprising:

a screen for closing an opening made in the fixed structure;

at least one compensating spring for compensating a weight of said screen, said spring being, in normal functioning of the installation, kinematically connected, by a first end, with the fixed structure and, by a second end, with said screen;

a coupling device including a stop spring disposed between said compensating spring and said screen and a first mounting to which one end of said compensating spring is kinematically linked to exert on said stop spring a centripetal or centrifugal effort (E) of blocking said stop spring with respect to said screen; and a second mounting means for adjusting a tension of said compensating spring, said second mounting means acting against said blocking effort (E) in order to allow selective adjustment of the tension of said compensating spring.

* * * * *